United States Patent [19]

Girard

[11] Patent Number: 4,647,061

[45] Date of Patent: Mar. 3, 1987

[54] SKI STIFFENED IN TORSION BY A BELLOWS-LIKE MEMBER

[76] Inventor: Donald A. Girard, P.O. Box 172, Rancho Cordova, Calif. 95670

[21] Appl. No.: 800,501

[22] Filed: Nov. 21, 1985

[51] Int. Cl.[4] ..... A63C 5/07

[52] U.S. Cl. ..... 280/602

[58] Field of Search ..... 280/602, 609, 610, 601, 280/12 R, 12 A, 28, 817; 441/68

[56] References Cited

U.S. PATENT DOCUMENTS

| | | | |
|---|---|---|---|
| 3,096,530 | 7/1963 | Almgren | 280/817 |
| 3,761,106 | 9/1973 | Schwarz | 280/817 |

FOREIGN PATENT DOCUMENTS

| | | | |
|---|---|---|---|
| 73009 | 11/1982 | European Pat. Off. | 280/602 |
| 3437865 | 5/1985 | Fed. Rep. of Germany | 280/610 |
| 945374 | 5/1949 | France | 280/817 |

*Primary Examiner*—David M. Mitchell

*Attorney, Agent, or Firm*—Owen, Wickersham & Erickson

[57] ABSTRACT

A ski that is stiff in torsion and is flexible in the vertical direction. The ski body that is relatively weak and flexible both in beam and in torsion, having a ski binding area in between its ends for affixation of a user's ski boot, providing forward and rear top surface portions. At least one bellows members is rigidly secured atop said ski body, it may be on said forward surface portion, or on said rear surface portion, or on both surface portions.

15 Claims, 6 Drawing Figures

SKI STIFFENED IN TORSION BY A BELLOWS-LIKE MEMBER

This invention relates to an improved snow ski.

BACKGROUND OF THE INVENTION

Skis have various characteristics that affect the ease of skiing and the ability of the skier to achieve or to fail to achieve a high level of proficiency. Thus, a good ski exhibits straight line stability at high speed, and also, the ability to turn easily and to absorb bumps and ripples in the snow. In addition, it should show an ability to traverse across a steep slope without side slip.

Skis include a core, which may be made of any of various materials, such as wood, foam, honeycomb, and various laminated materials. The core controls most of the resilience of the ski.

The bottom surface of the ski is made of a material which is slick, such as a suitable plastic that slides well over the snow, and this bottom portion is bonded to the bottom of the core.

The sides and the top of the ski may be of wood, or of plastic, or metal, but are usually of a type of material different from the bottom, because slipping and sliding is not their function. The sides and top are also bonded to the core, and are preferably surrounded with a waterproof covering, which may also provide decoration.

The bottom is usually provided with metal edges that function to cut into the ice or hard snow so that the ski can bite and can hold a turn without sliding sideways. These metal edges also help when traversing a slope, and when the skier wishes to stop. The skier himself causes these metal edges to bite into the snow by angling his legs, and thus the skis, in the direction of the turn.

Good skis are usually narrower in the center than at the tips when viewed in plan, so that the sides to which the metal edges are affixed form a large arc. This arc helps to cause the ski to start turning when it is angled. The longer the portion of the metal edge that cuts into the snow, the more lateral force the ski can exert to enable the skier to turn sharper and more quickly. Skis are limber and do not twist uniformly long their length when the skier angles them to turn.

Heretofore, such skis have been weak in torsion, so that the tips, the front, and the rear would not angle as much as did the center where the ski boot is attached, as by bindings. This weakness in torsion has forced skiers to accentuate the angularity of their legs, and the ends of the ski did not achieve the same edge hold that would have been obtained if the ski had not twisted. Such a twisted ski could not exert the amount of force on a turn that an untwisted ski could, and thus, is a source of inefficiency.

Another important quality in skis is their compliance, their flexurability in the vertical direction. A highly compliant ski makes the ride smoother over the snow, enables the skier to maintain his balance more easily, and achieves a relatively even pressure distribution along the length of the ski as applied to its bottom surface. Pressure along this bottom surface is a factor in making skis run fast. Areas of extreme pressure due to low compliance are certainly undesirable.

While a ski could be made to be very stiff in torsion by making it much thicker, it would then be much less compliant when moving over ripples and bumps and deep depressions in the snow, so that the overall result would be unsatisfactory. The compliance of a ski relates to its stiffness or flexibility in beam. A very thick ski would be relatively stiff and not compliant. However, it is desirable to have high compliance, and so it is desirable for a ski to be relatively weak in beam. On the other hand, twisting of the ski takes place because a typical ski is very weak in torsion. Both types of action—compliance and torsion—may occur separately or simultaneously, depending on the terrain and on the action of the skier.

In the past skis have been relatively weak in both beam and torsion. It would be easy, as indicated earlier, to make such a ski stiff in both beam and in torsion, but it has been nearly impossible to make the ski weak in beam and yet stiff in torsion. However, this is what is basically desired in a ski.

An object of the present invention is to accomplish stiffness in torsion, while leaving the beam flexible, or relatively weak, so that the beam strength is relatively low, but the torsion stiffness is high.

Another object of the invention is to enable a designer to control each of the two factors, torsion and beam strength, almost independently of each other. Usually this can be effected by starting with a ski design that is weak in beam and weak in torsion, and then by applying the principles of the present invention, the torsional rigidity can be increased without substantially affecting the beam flexibility.

SUMMARY OF THE INVENTION

The present invention may start with a ski of typical good current design, which is relatively weak or flexible, both in beam and in torsion. Bellows-like members are then placed at forward portion of the ski or at a rearward portion, or both, i.e., ahead and/or behind the area where the ski boot will be placed. These bellows-like members may be roughtly tubular or semicircular tubular members or even rectangular or hexagonal in shape. Each bellows-like member is imperforate in between its ends. They may be either open or closed at each end; if closed, a small air vent opening is provided through one of the end closure members, serving as a dampening means.

As the ski flexes in beam, the bellows-like member, which is flexible, so far as this kind of force is concerned, offers no additional resistance. However, when the ski is subjected to a high torque, i.e., a twisting force, the bellows-like member resists this twist, and it imparts its stiffness in torsion to the ski itself, so that the ski is relatively stiff in torsion, even though it is still relatively weak or flexible in beam.

Other objects and advantageous of the invention will appear from the following description of a preferred embodiment.

DESCRIPTION OF A PREFERRED EMBODIMENT

Figures 1, 2, 3, 4, 5, 6:
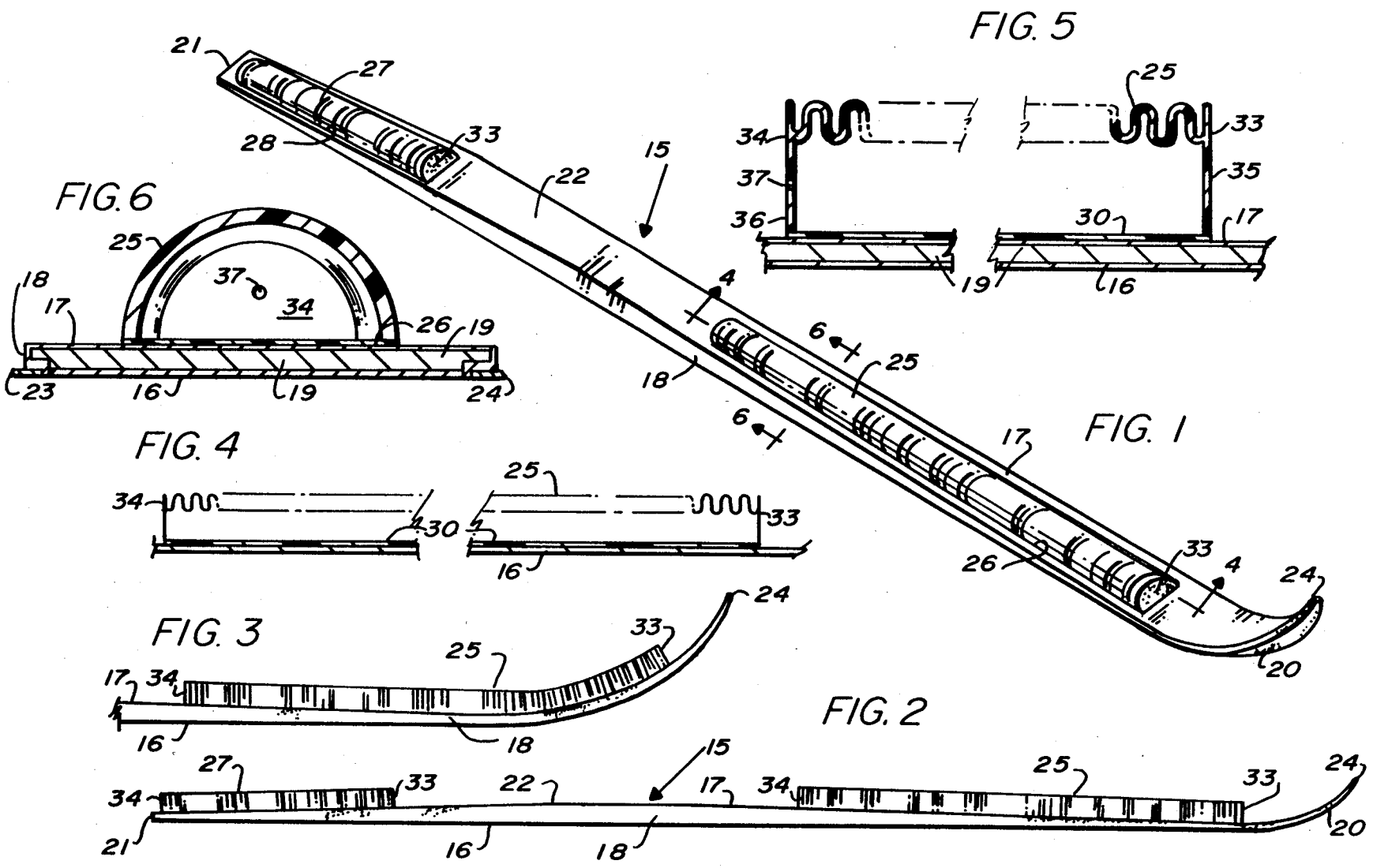
FIG. 1 is a view in perspective of a ski embodying the principles of the invention.
FIG. 2 is a view in side elevation of the ski of FIG. 1.
FIG. 3 is a fragmentary view in side elevation of the front portion of the ski in which the turned-up front is being flexed upwardly, and thereby tending to compress the bellows-like member.
FIG. 4 is an enlarged view in section along the line 4—4 in FIG. 1, of one of the open-end bellows-like member as mounted on the ski.
FIG. 5 is another further enlarged view in section broken in the center showing a ski-mounted bellows-like member with closed end plates, one of which has an air opening through it.
FIG. 6 is a view in section taken along the line 6—6 in FIG. 1.

The drawings show a ski body 15 having a slick bottom surface 16, a top surface 17, and side surfaces 18, the top and side surfaces 17 and 18 helping to protect a core 19. The ski has a turned up forward end 20 and a rear end 21. In between these two ends is an area 22 for placing the boot and bindings. The ski 15 is preferably wider at its front end 20 and at its rear end 21 than at the area 22 in between them. Along the bottom edges are sharp metal inserts 23 and 24 (See FIG. 6).

In the present invention the top surface 17 is provided with one or, preferably, two imperforate bellows-like members 25 and 27. Thus, preferably, there may be both a forward bellows-like member 25 secured rigidly on top of the ski on a forward area 26 and a rear bellows-like member 27 on a rear area 28, or there may be only one such bellows-like, either fore or aft. Seen in transverse cross section (FIG. 6), these bellows-like members 25 and 27 may be substantially semicircular rather than a full circle, and in that event each bellows-like member 25 or 27 preferably has a bottom plate 30 to which is secured the bellows-like member proper 25 or 27. This bottom plate 30 makes manufacturing easier, although it is not essential. The front and rear ends 33 and 34 may be fully open as shown in FIG. 4. Alternatively, these ends 33 and 34 may be closed by plates 35 and 36, as shown in FIGS. 5 and 6. If the ends 33 and 34 are closed, one of these plates 35, 36 has a small air vent opening 37, to serve as dampening means. The bottom plate 30 may be glued on otherwise secured to the ski's upper surface 26 or 28. If desired, the securement may be in a recess; instead of the plate 30, other means of securement may be used, such as flanges at the lower surface of the bellows-like member 25 or 27, but in any event, the interior of the bellows-like member is fully enclosed lengthwise.

Instead of an attachment to an already made ski, the bellows-like member 25, 27 may be an integral part of the ski itself. Thus, a plastic sheet, may be expanded upwardly, as by hydroforming, in the center while anchored to the ski on each side of the sheet. In any event, the bellows-like member itself becomes a part of the ski; in effect forming part of the top protective cover of the ski body 15; along with the top surface portion 17.

Plastic, suitably stiff but also flexible, is the preferred material from which the bellows-like member are made, though metal may be used. Thus an epoxy-fiberglass composite may be used for both the bellows portion and the base plate 30. Polycarbonate or Lexan may be used. Thin metal is possible, though usually less desirable.

As stated, the bellows-like member 25 and 27 are imperforate between their ends. The ends themselves may be open, as shown in FIG. 4, or closed, as shown in FIG. 5.

Such a bellows-like member 25 or 27 offers no resistance vertically; so that the ski can be flexed and therefore allow motion between the center portion 22 of the ski and its ends 20 and 21, in order to provide the desired compliance. Thus, when the ski 15 is flexed, as for example in FIG. 3, the bellows-like member 25 or 27 does not resist this flexure.

However, bellows-like member 25 or 27 is not easily twisted, being relatively stiff in torsion, due partly to its being tubular in nature and partly to its having its tube-like structure closed by a base plate 30 or by being sealed and anchored to the ski surface 26 or 28, to which the compressible portion of the bellows-like member 25 or 27 is rigidly secured. Therefore, this bellows-like member 25, 27 strongly resists twisting forces. The front and rear bellows-like member 25, 27 act similarly, although the rear member 27 may be somewhat shorter, and may, in fact, in some embodiments be omitted if that is desired, since the principal flexure takes place at the front. Similarly, the front bellows-like member 25 may be omitted if desired.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A ski that is stiff in torsion and is flexible in the vertical direction, comprising a ski body that is flexible both in beam and in torsion, having a bottom surface and a top surface, a curved-up front end, a rear end, and a ski binding area in between its ends for affixation of a user's ski boot, providing a forward top surface portion and a rear top surface portion, at least one bellows-like member rigidly secured to said ski body, said bellows-like member extending lengthwise of said ski body and being compressible lengthwise when the ski body is bowed and rigid widthwise and vertically, and being imperforate, thereby enclosing a hollow interior.

2. The ski of claim 1 wherein said bellows-like member is open at each end.

3. The ski of claim 1 wherein said bellows-like member is closed at each end except for a small vent opening through one end.

4. The ski of claim 1 wherein said bellows-like member is semicircular in transverse cross-section and has a base plate which is rigidly secured to the ski body.

5. The ski of claim 4 wherein said base plate is adhesively secured to a said top surface portion.

6. The ski of claim 4, wherein said bellows-like member is closed by a pair of end plates, with a dampening vent opening in one said end plate.

7. The ski of claim 1 wherein said bellows-like member is rigidly secured to said forward top surface.

8. The ski of claim 1 wherein said bellows-like member is rigidly secured to said rear top surface.

9. The ski of claim 1 wherein there are two said bellows-like member, one secured to said forward top surface and one secured to said rear top surface.

10. The ski of claim 1 wherein said bellows-like member is a separate plastic member.

11. The ski of claim 1 wherein said bellows-like member is a plastic member integral with said ski.

12. A ski that is stiff in torsion and is flexible in the vertical direction, comprising a ski body that is flexible both in beam and in torsion, having a bottom surface and a top surface, a curved-up front end, a rear end, and a ski binding area in between its ends for affixation of a user's ski boot, providing a forward top surface portion and a rear top surface portion, a pair of longitudinally imperforate bellows-like member rigidly attached atop said ski body each said bellows-like member extending longitudinally of said ski, one on said forward surface portion, one on said rear surface portion, each bellows-like member being compressible lengthwise and rigid widthwise and vertically and enclosing a hollow interior.

13. The ski of claim 12 wherein each said bellows-like member is semicircular in transverse cross-section and has a base plate which is adhesively secured to the ski body.

14. The ski of claim 13 having a pair of end plates closing said hollow interior, one of said end plates having a dampening vent opening.

15. The ski of claim 12 having a pair of end plates closing said hollow interior, one of said end plates having a dampening vent opening.

* * * * *